US011679843B2

(12) United States Patent
Lie Eide et al.

(10) Patent No.: US 11,679,843 B2
(45) Date of Patent: Jun. 20, 2023

(54) ENERGY ABSORPTION ARRANGEMENT FOR REDUCING PEAK MOORING LOADS

(71) Applicant: APL Norway AS, Kolbjørnsvik (NO)

(72) Inventors: Anders Lie Eide, Arendal (NO); Geir Olav Hovde, His (NO)

(73) Assignee: APL NORWAY AS, Kolbjørnsvik (NO)

( * ) Notice: Subject to any disclaimer, the term of this patent is extended or adjusted under 35 U.S.C. 154(b) by 333 days.

(21) Appl. No.: 17/272,594

(22) PCT Filed: Sep. 4, 2019

(86) PCT No.: PCT/NO2019/000024
§ 371 (c)(1),
(2) Date: Mar. 1, 2021

(87) PCT Pub. No.: WO2020/050724
PCT Pub. Date: Mar. 12, 2020

(65) Prior Publication Data

US 2021/0354789 A1 Nov. 18, 2021

(30) Foreign Application Priority Data

Sep. 5, 2018 (NO) ..... 20181157

(51) Int. Cl.
*B63B 21/50* (2006.01)
*B63B 21/00* (2006.01)

(52) U.S. Cl.
CPC ..... *B63B 21/50* (2013.01); *B63B 2021/001* (2013.01); *B63B 2021/005* (2013.01)

(58) Field of Classification Search
CPC ..... B63B 21/50; B63B 2021/001; B63B 2021/005; B63B 2021/501; B63B 21/00; B63B 21/18; B63B 22/00; B63B 22/025; B63B 27/00
See application file for complete search history.

(56) References Cited

U.S. PATENT DOCUMENTS

| | | | |
|---|---|---|---|
| 4,088,089 | A | 5/1978 | Flory |
| 4,493,282 | A | 1/1985 | Ortloff |
| 6,439,147 | B2 | 8/2002 | Cottrell et al. |
| 2001/0029879 | A1 | 10/2001 | Cottrell et al. |
| 2014/0014017 | A1 | 1/2014 | Balleraud et al. |

FOREIGN PATENT DOCUMENTS

| | | | |
|---|---|---|---|
| EP | 2 070 812 | A1 | 6/2009 |
| WO | WO 03/059728 | A1 | 7/2003 |
| WO | WO 2007/096019 | A1 | 8/2007 |

OTHER PUBLICATIONS

International Bureau, Search Report and Written Opinion in International Application No. PCT/NO2019/000024 dated Oct. 31, 2019.

*Primary Examiner* — Anthony D Wiest
(74) *Attorney, Agent, or Firm* — Leydig, Voit & Mayer, Ltd.

(57) ABSTRACT

An energy absorption arrangement for reducing peak mooring loads between a mooring structure with a turret rotatable around a vertical axis, and a floating structure is disclosed. The energy absorption arrangement comprises a rigid yoke horizontally rotatable in two axes and connected to the turret, a weighted pendulum member arranged on the end of the yoke and at least one mooring tether connected to the weighted pendulum member, and at least one energy absorption device for reducing peak mooring loads, comprising a fixed part connected to the floating structure, a movable rod and an absorption medium.

20 Claims, 13 Drawing Sheets

ENERGY ABSORPTION ARRANGEMENT FOR REDUCING PEAK MOORING LOADS

CROSS-REFERENCE TO RELATED APPLICATIONS

This patent application is the U.S. National Stage of International Patent Application No. PCT/NO2019/000024, filed Sep. 4, 2019, which claims the benefit of Norwegian Patent Application No. 20181157, filed Sep. 5, 2018, which are each incorporated by reference.

TECHNICAL FIELD

The present invention relates to an arrangement for mooring a floating vessel, in which the arrangement comprises a rigid yoke, which at one end is connected via a three-degree of freedom rotational joint to a structure attached to the sea floor, and at the other end to the floating vessel via at least one mooring tethers, and where a mooring load reducing device is attached to the connection points on the floating vessel.

BACKGROUND

For mooring, loading and unloading a floating vessel in shallow waters, such as a Floating Production, Offloading and Storage (FPSO) vessel, Floating Storage and Offloading (FSO) vessel, Floating Storage and Regasification Unit (FSRU), Floating Liquified Natural Gas (FLNG) vessel, etc., one possible mooring and fluid transfer arrangement is to use a submerged turret yoke system. This system or arrangement comprises a structure attached to the sea floor. A rigid yoke is further attached to this structure by a turret that makes it possible for the yoke to rotate around the vertical axis of the said structure. The yoke is further fitted with rotational means, located close to the turret, allowing the yoke to also rotate around the two other rotational axes. At the other end the yoke is attached to mooring tethers, which are further connected to the floating vessel. The tethers have limited or full freedom to rotate around its own axis. The position restoring forces of the vessel from the yoke system is then obtained by adding permanent ballast to the yoke at a distance from the turret table that typically coincides with the connection points for the tethers. The total weight of the yoke, including the required amount of ballast, can be significant, and especially if the arrangement shall moor the vessel in extreme weather conditions.

The fluid transfer from the structure on the sea floor and the floating vessel is typically via a fluid swivel on the said structure, hard pipes, flexible lines and required valve arrangement. The fluid swivel can be located either subsea or above sea level. The rotational axis of the fluid swivel is the same as for the turret.

Designing a mooring arrangement in shallow water can in areas with very extreme weather conditions prove difficult, and especially due to the extreme non-linear characteristics of the restoring force the extreme loads in the system may be very sensitive to the actual wave train, even though the wave spectrum is the same. An arrangement that can reduce the wide scatter in the potential extreme loads may thus be required.

Related prior art is disclosed in U.S. Pat. No. 6,439,147B2, WO2007/096019A1 and US2014/0014017A1. These prior arts focus on increasing the general damping of the vessel or yoke motion and thereby reducing the extreme loads, while the present invention focus on reducing the extreme peak loads in the arrangement only.

In order to reduce the peak loads in a mooring arrangement a damping arrangement according to claim 1 is provided.

Short Summary of the Invention

The invention relates to an energy absorption arrangement for reducing peak mooring loads between a mooring structure with a turret rotatable around a vertical axis and a floating structure. The energy absorption arrangement comprises a rigid yoke horizontally rotatable in two axes and connected to the turret, a weighted pendulum member arranged on the end of the yoke and at least one mooring tether connected to the weighted pendulum member, and at least one energy absorption device for reducing peak mooring loads, comprising a fixed part connected to the floating structure, a movable rod and an absorption medium. Mooring loads up to a first predetermined load is absorbed by the weighted pendulum, and mooring loads higher than the first predetermined load is absorbed by the at least one energy absorption device, wherein the rod, whose outer end is connected to the at least one tether has an initial first length when exposed to a mooring load up to the first load and is extended a second length when exposed to a second load greater than the first load and the second length is longer than the first length. The energy absorption device exerts a restoring force opposite of the first and second load, causing the rod to retract from its second length to its first length when the mooring loads decreases from the second load to the first load.

BRIEF DESCRIPTION OF THE FIGURES

Below, various embodiments of the invention will be described with reference to the figures, in which like numerals in different figures describes the same features.

DETAILED DESCRIPTION OF PREFERRED EMBODIMENTS

Figure 1:
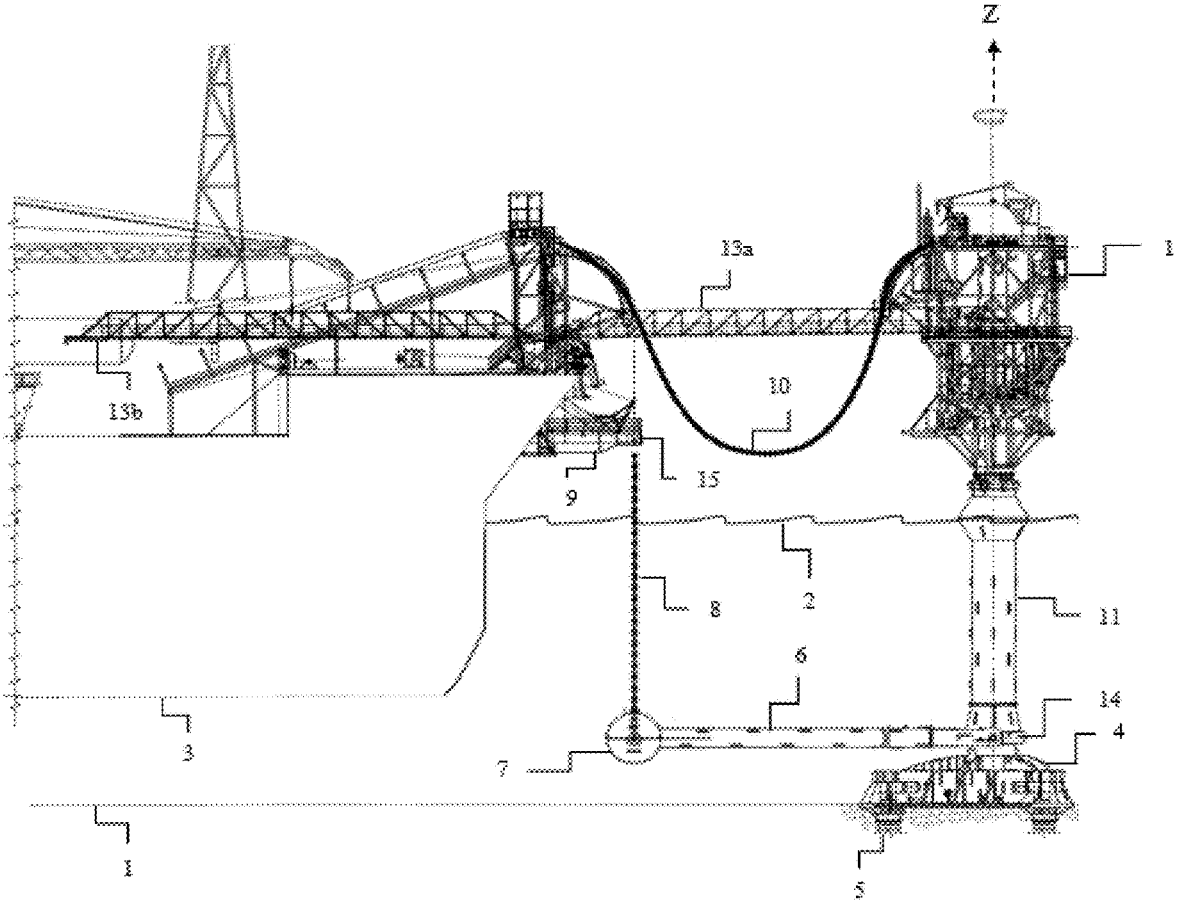
FIG. 1 shows a side view of typical general arrangement of a vessel connected to a submerged yoke system with fluid swivel above sea level.

This invention describes a system and a method for reducing the peak loads in a mooring yoke arrangement for a floating structure 3, such as a vessel, tanker, barge or boat, in which the mooring yoke arrangement is connected to the vessel via typically mooring tethers 8 and at least one fluid line 10. The system comprises several devices on the vessel such as mooring arms 9, mooring cradles 15, energy absorbing devices 22, sliding paths 30, and stopper arrangements 28, 29. The parts of the mooring yoke arrangement not located on the vessel comprise devices such as such as mooring tethers 8, which mates with the mooring cradles 15 on the vessel, a mooring yoke 6 with a weighted pendulum part 7 and x-axis rotational means 17 and y-axis rotational means 18, a turntable, such as a mooring turret, and structure 4 attached to the sea floor 1 by foundation means 5.

The major difference from a typical yoke system is the introduction of the energy absorbing device 22, which affects the mooring restoring characteristics such that the maximum loads in the system reduces for the same amount of stored energy in the restoring system. This stored energy is the systems capability to absorb the kinetic energy from the motion of the floating structure.

In one embodiment the energy absorbing device 22 is part of the equipment on the vessel, as described above. In another alternative embodiment the energy absorbing device 22 is part of the mooring tether 8 or part of the x-axis rotational means 17 for rotation about the x-axis.

To ease the explanation, we use an orthogonal axes system wherein the z-axis coincides with the centerline of the tower 11, turret 14 and fluid swivel 12. The x-axis is in the length direction of the yoke 6, while the y-axis is in the beam direction of the yoke. The length axis of the yoke 6 is in the same vertical plane as the plane containing the vector defined by a line between the vessel 6 and the tower 11.

FIG. 1 gives an overall view of a submerged yoke arrangement with the fluid swivel above sea surface 2. The system comprises a subsea structure 4, which is attached to the sea floor 1 by foundation means 5, which can be driven piles, drilled and grouted piles, suction piles, weight element (s), etc. A tower structure 11 is attached on top of structure 4. This tower structure comprises an inner and outer part, where the inner part (geo-stationary part) is fixed to the structure 4, while the outer part is connected to the yoke 6 and can rotate around the inner part by the turret 14. At the top of the tower the fluid swivel and associated piping and valves are mounted, which is herein defined as the topside 12. The topside 12 is also divided into a geostationary part and a rotating part. The rotation of the rotating part is driven by the weather-vaning of the vessel 3 via the yoke 6 and the outer part of the tower 11. Fluid, power and utility lines 10 are at one end connected to the rotating part of the topside 12 and to the vessel 3 at the other end. The yoke 6 has a weighted pendulum member 7 which provides the mooring restoring characteristics of the yoke system. The yoke 6 is further connected to the vessel via mooring tethers 8, which at the lower end is connected to the yoke close to the weighted member 7, and at the upper end is connected to a mooring cradle 15 mounted on a mooring arm 9 on the vessel 3. Further, an access bridge 13 between the vessel 3 and the topside 12 secures that personnel can access the topside from the vessel. This bridge can be disconnected at the topside and swung around a pedestal at the vessel into parked position on the vessel, when not in use or when the weather conditions gets rougher than the operational limits of the bridge. The bridge may be of a telescopic type to obtain a wide envelope of relative motions between vessel and topside.

Figure 2:
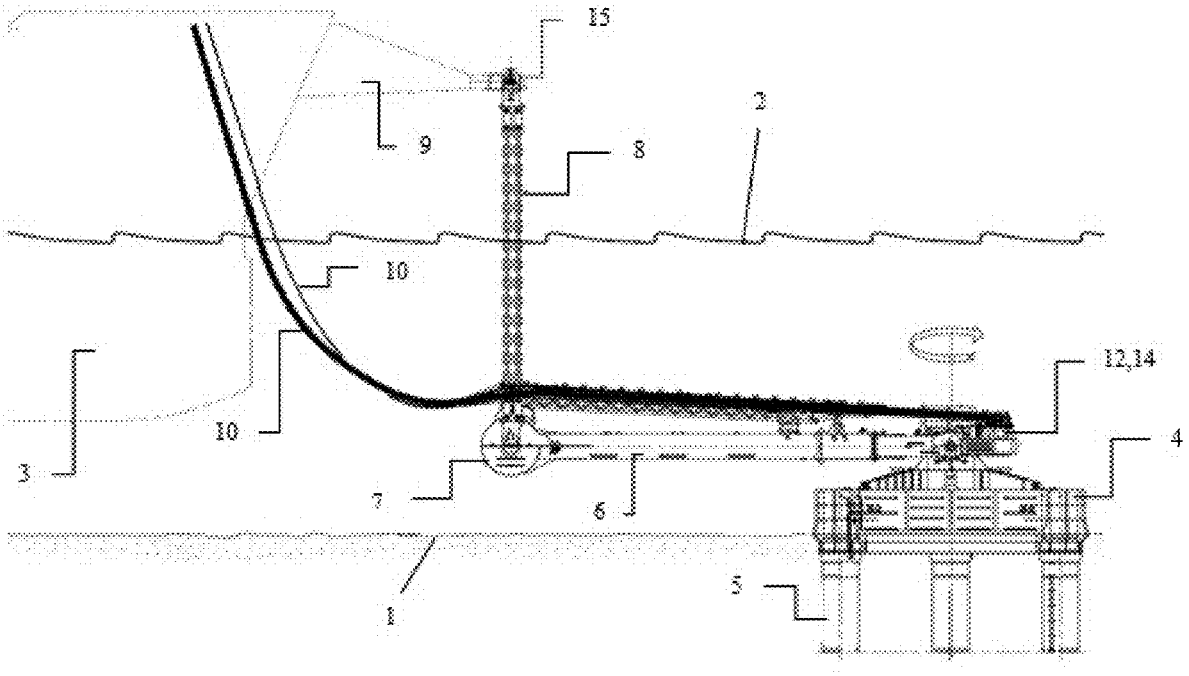
FIG. 2 shows a side view of a typical general arrangement of a vessel connected to a submerged yoke system with fluid swivel below sea level, i.e. subsea fluid swivel.

FIG. 2 gives an overall view of a submerged yoke arrangement with the fluid swivel below sea surface 2. The arrangement is very similar to the arrangement shown in FIG. 1. The main difference is that the tower structure 11 and the access bridge 13 are not present, and the fluid swivel and associated piping and valves 12 are located subsea directly on top of the structure 4. This arrangement is typically applied when the number of fluid lines 10 are few.

Figure 3:
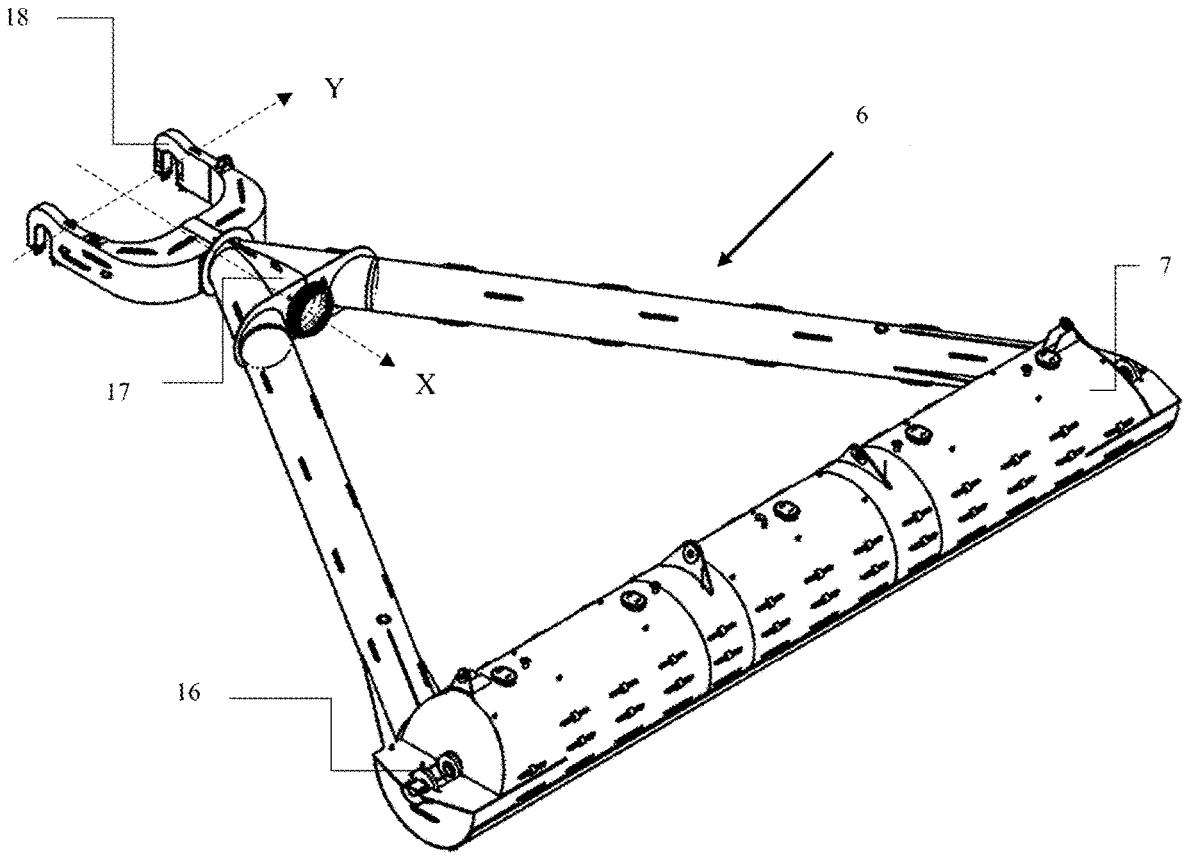
FIG. 3 shows a typical general arrangement of the mooring yoke.

FIG. 3 shows a typical mooring yoke 6. The yoke is at one end connected to the mooring tethers 8 via attachment means 16. The weighted member 7 is typically a large tank, which can be filled with ballast to obtain the weight required for the targeted mooring restoring characteristics. The attachment means 16 and the weighted member 7 is typically, but not necessarily, located at the same length position (x) of the yoke. The inner end provides a two degrees-of-freedom joint connection towards the turret 14. Rotation is obtained by x-axis rotational means 17 and y-axis rotational mean 18. The y-axis rotational means 18 attaches the yoke 6 to the turret 14.

Figure 4:
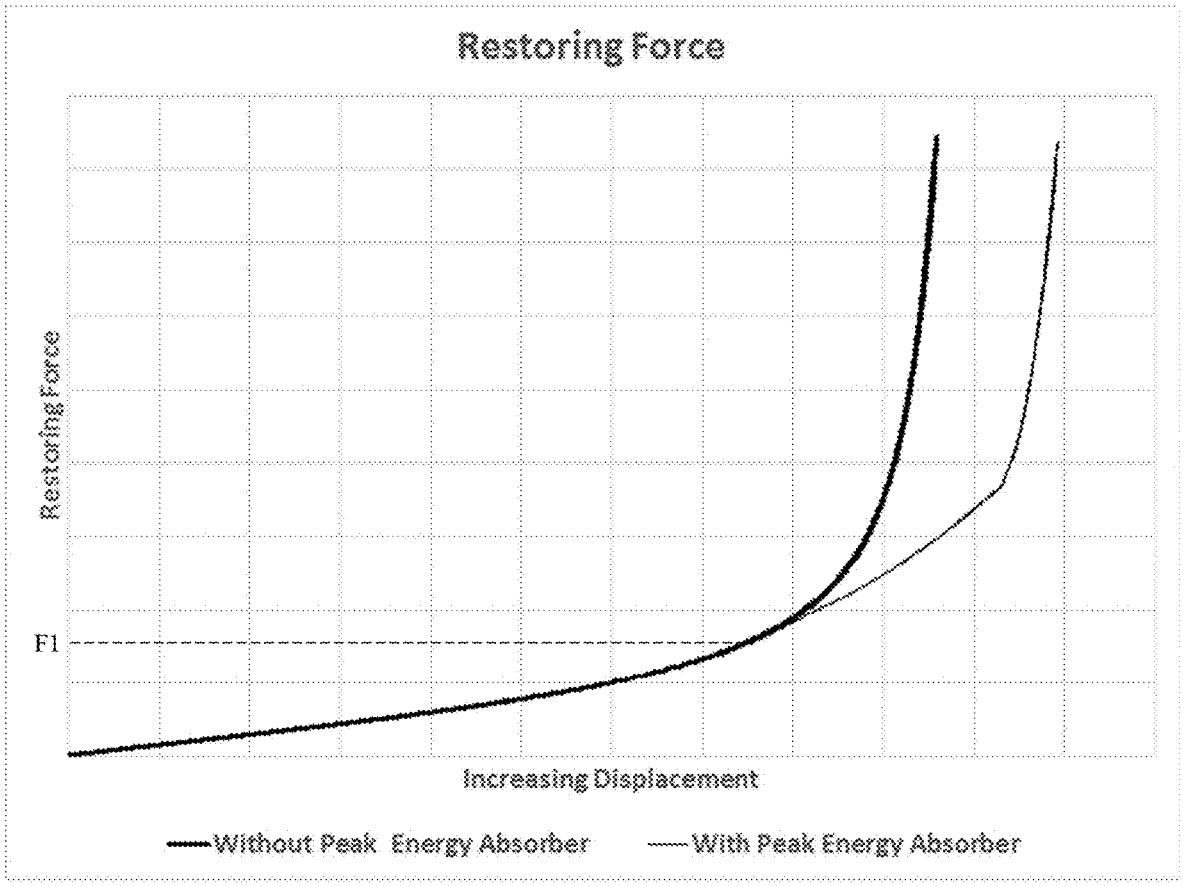
FIG. 4 shows the restoring force as function of vessel displacement for a yoke system, both without and with a peak energy absorber.

FIG. 4 shows a typical restoring force for a yoke system without a peak energy absorber and with a peak energy absorber. For a system without a peak energy absorber the restoring characteristic is defined entirely by the dimensions and the weight of the yoke system together with the stiffness characteristics of the structural components. The figure shows the exponentially increasing restoring force for increasing displacement (offset) of the floating vessel. This restoring behavior implies that for just a small change in the wave train or a small change in the weather condition the loads in the system may change significantly. To reduce the sensitivity in loads due to such changes a peak energy absorber is introduced. This device affects the system restoring for loads above a defined extreme level F1 (also referred to as the pre-tension for the device) in such a way that a larger vessel displacement can be accepted by the system. This defined extreme level is typically, but not necessarily, defined as a load close to the most likely extreme loads, i.e. the energy absorbing device only affects the restoring characteristic for incidents with a probability of occurrence less than the most likely extreme incident.

In the most extreme events, mooring loads could reach dangerously high levels and the floating structure will need to disconnect from the mooring arrangement. The energy absorption device will therefor decrease the probability of needing to disconnect.

Figure 5:
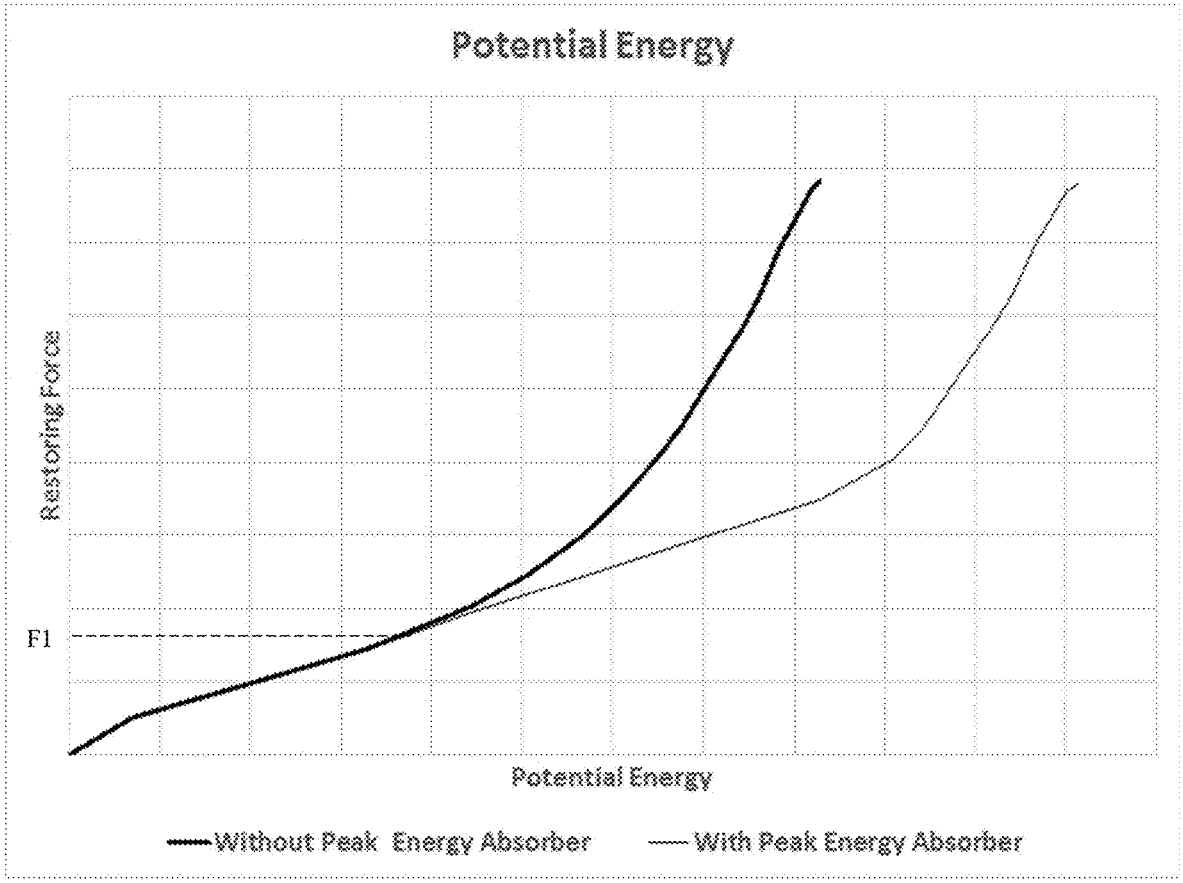
FIG. 5 shows the restoring force as function of energy stored in the restoring system, both without and with a peak energy absorber.

FIG. 5 shows the maximum restoring force as function of the stored energy without and with a peak energy absorber. For loads below the predetermined level F1 it is seen that the stored energy (energy available for absorbing the kinetic energy in the yoke-vessel system) is the same for a system without and with a peak energy absorbing device, while for loads above this level the system with a peak absorbing device has higher stored energy than a system without the said device for the same restoring force.

Figure 6:
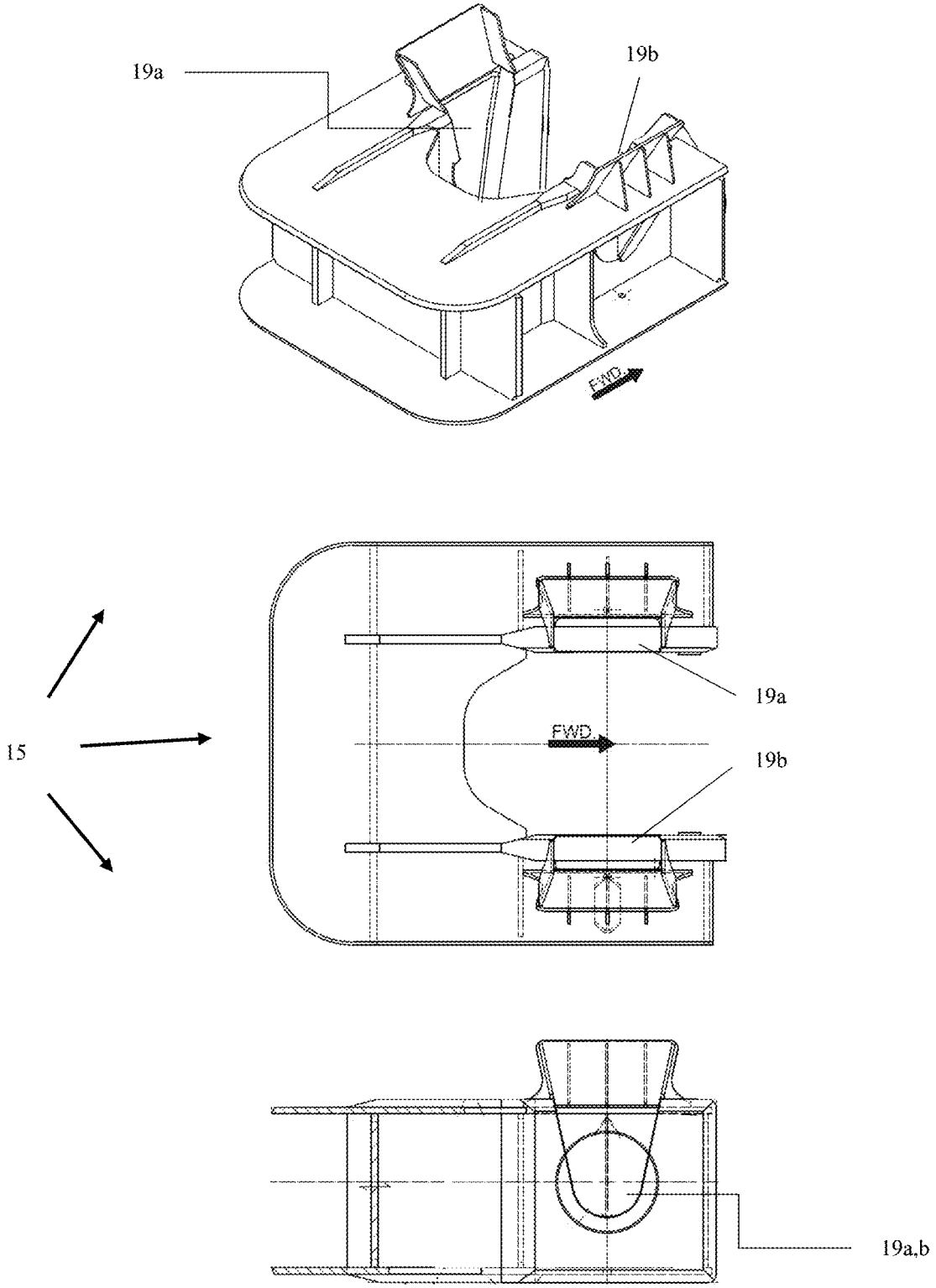
FIG. 6 shows a typical mooring cradle for the tether hang-off on the vessel.

FIG. 6 shows a typical arrangement for the mooring cradle 15. In this embodiment the main pin 21 of the mooring tether 8 is placed into the grooves 19*a,b* of the mooring cradle. The grooves are typically open in the top and closed at the bottom for easy installation and connection. This means that the pin will be placed in the grooves from the top and prevented from falling out. A securing device can be added to prevent the tether to work itself out through the open part, but due to the weight of the yoke and by a proper design of the grooves this is considered as an unlikely event.

Figure 7:
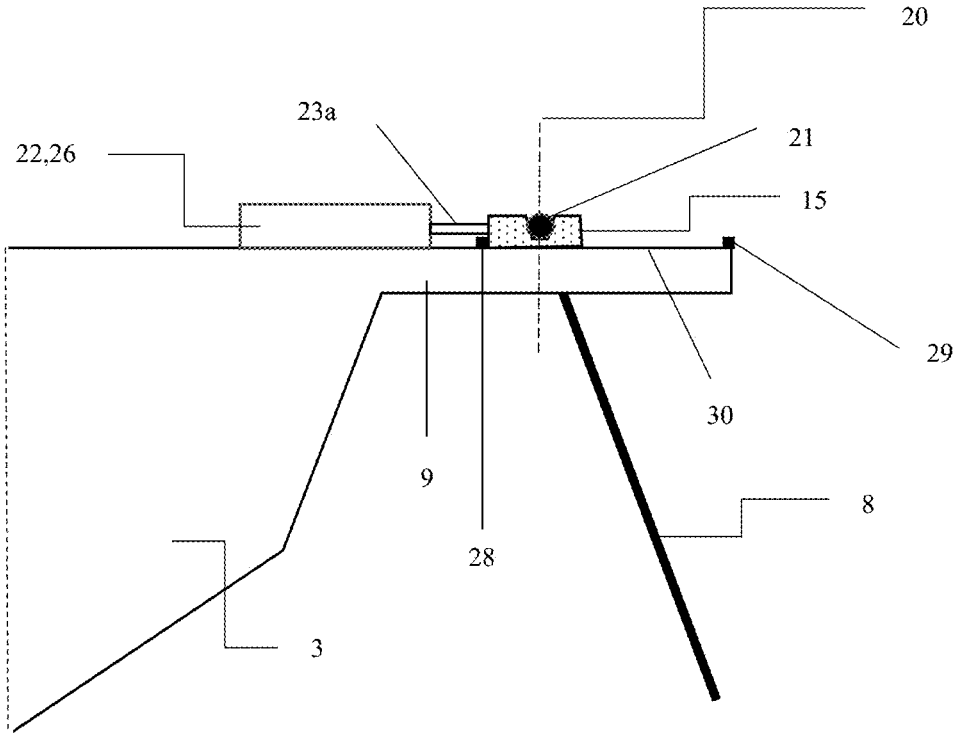
FIG. 7 shows the mooring cradle and energy absorber in nominal position.

In one embodiment the mooring cradle 15 is connected to a rod 23 of the energy absorption device 22 as shown in FIG. 7. The main body of the energy absorption device 22 is then fixed to the mooring arms 9 of the vessel 3. The mooring cradle 15 can further slide on a sliding path 30, which is integrated in the mooring arm 9. The sliding path or mooring arm is fitted with an inner stopper 28 and an outer stopper 29, which defines the allowable operating sliding range of the mooring cradle. These stoppers can alternatively be integrated directly in the energy absorption device, but then the energy absorption device needs to be designed for the potential loads in the system after the rod has reached its maximum displacement, which may not be the preferred load path for these potential high loads. The sliding path and/or cradle will be fitted with device(s) that clearly defines the motion path of the cradle, e.g. device(s) that prevents the cradle from moving sideways. Further, the sliding path and/or cradle will typically be fitted with sliding bearing arrangements that provides low and predictable friction loads as well as predictable wear.

Figure 8:
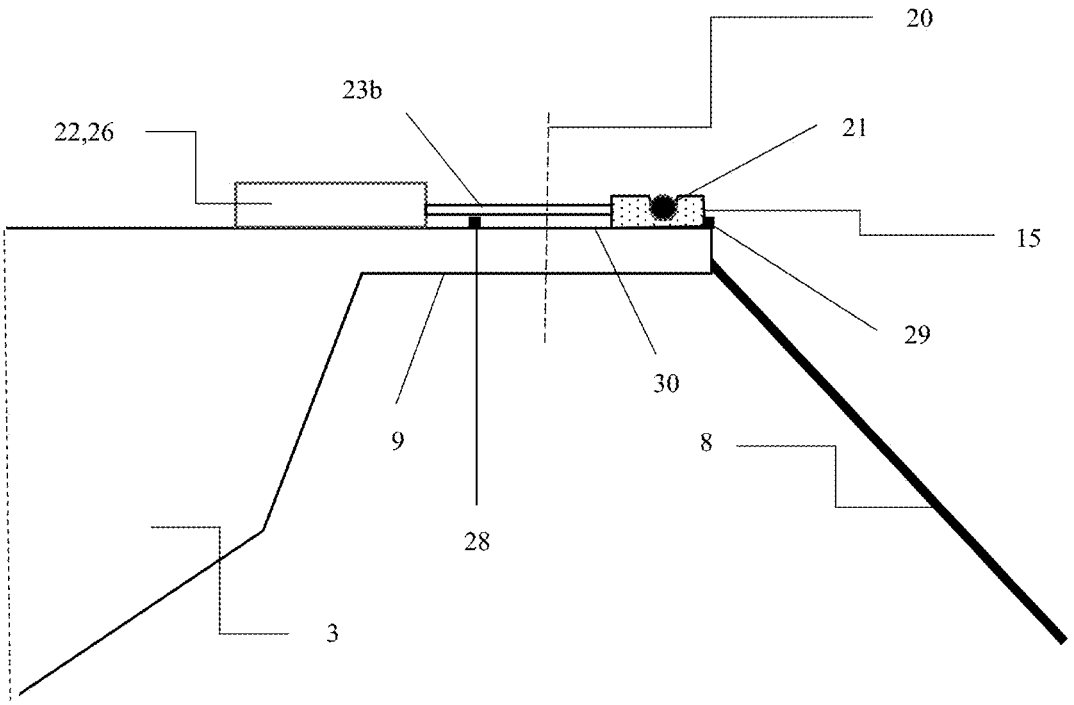
FIG. 8 shows the mooring cradle and energy absorber at maximum displacement position.
Figure 12:
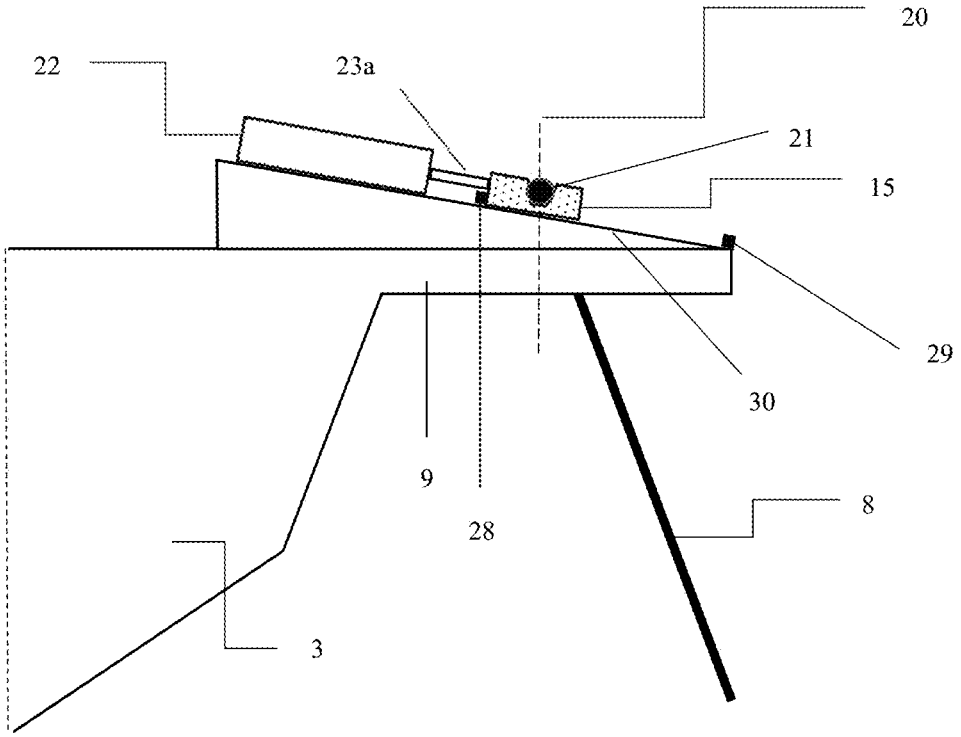
FIG. 12 shows the mooring cradle and energy absorber in nominal position for inclined sliding path.

FIG. 8 shows the same as FIG. 12, but with the rod at its maximum displacement position.

Figure 9:
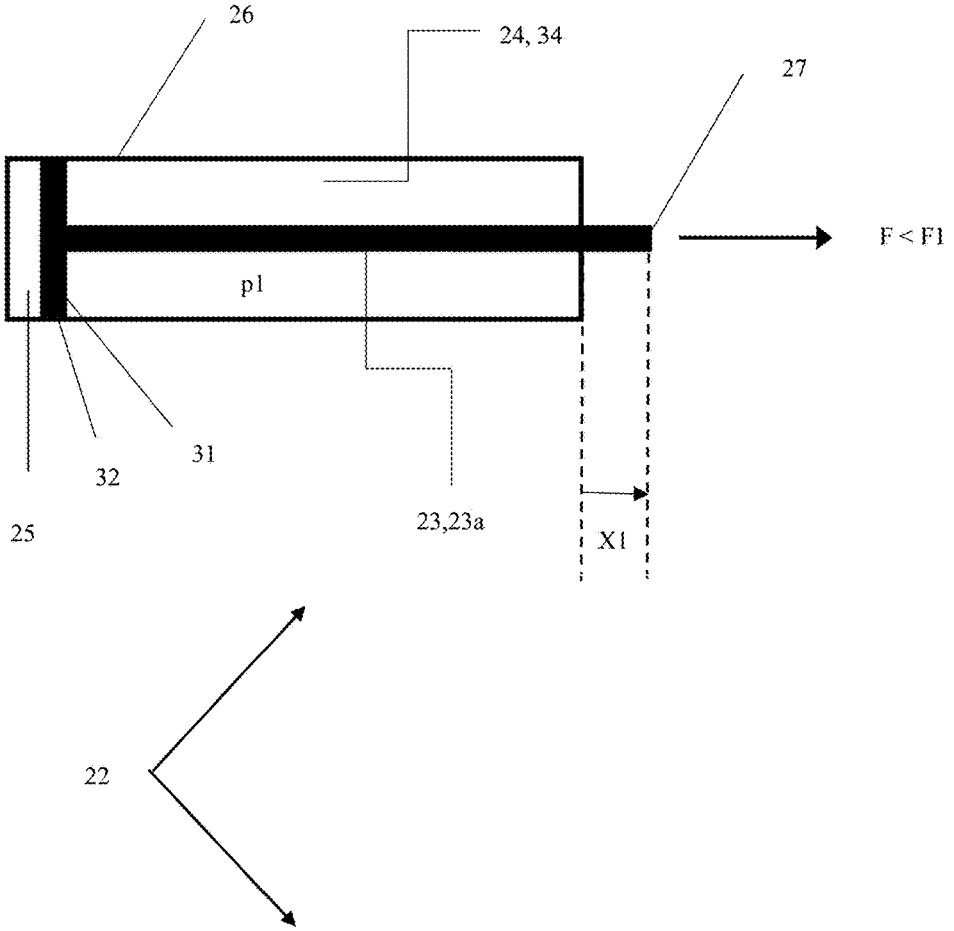
FIG. 9 shows a principal arrangement of the energy absorber based on compressible fluid only.
Figure 9:
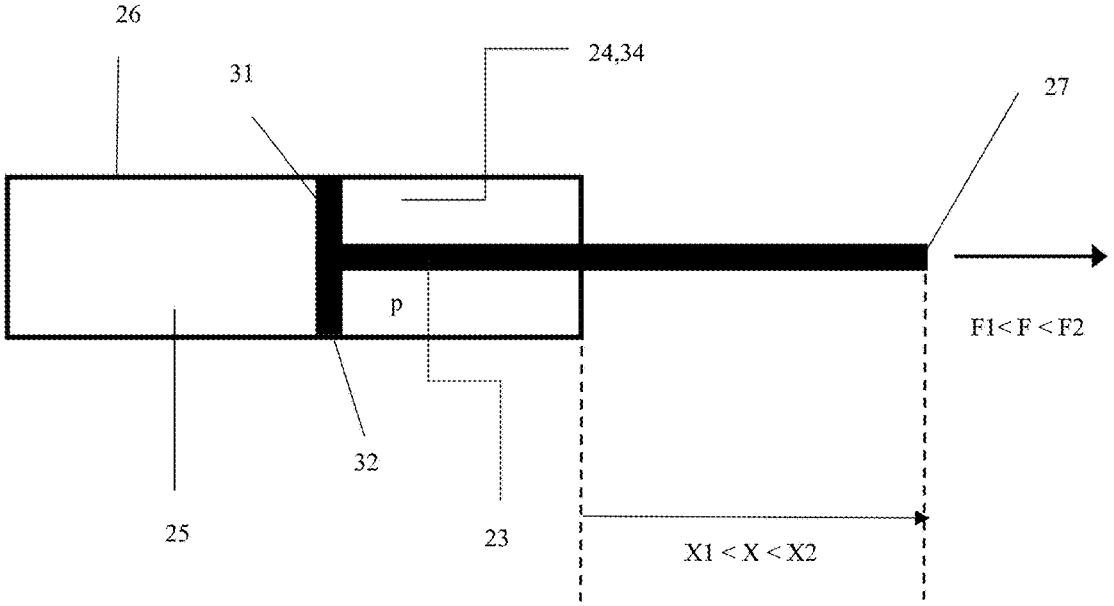

FIG. 9 shows one possible arrangement of the energy absorption device 22. In this embodiment the said device comprises a main body 26, which is fixed to the floating vessel 3, and a rod 23 with end plate 31 where the rod extends outside the main body and connects to the mooring cradle 15 at the end 27. The rod 23 can move inside the main body and thus provide a variable length of the energy absorption device 22. A high-pressure vessel/chamber 24 will be at one side of the end plate 31 and a low-pressure chamber 25 will be at the other side. The two pressure chambers are separated by a seal arrangement 32. The high-pressure vessel/chamber can in another embodiment be connected to external pressure chambers via piping to reduce the size of the main body 26. The low-pressure chamber can either be closed or open to the atmosphere. The nominal pressure p1 in the high-pressure chamber, which is the pressure associated with nominal position X1 of the rod, defines the minimum load F1 required to provide a displacement of the rod. For a passive arrangement the high-pressure vessel/chamber and the fluid inside must be such that the pressure increases for decreasing volume. This is typically obtained by using an absorption medium such as a compressible fluid 34, such as nitrogen gas, which would be known by a person skilled in the art.

An active arrangement for adjusting the pressure of the absorption medium and thus the spring characteristics is also possible, but for such an arrangement an incompressible fluid, such as oil, will typically be used together with an actively controlled Hydraulic Power Unit (HPU) or pump.

FIG. 9*a* shows the device 22 with the rod 23 at its nominal position, while FIG. 9*b* shows the energy absorption device 22 with the rod 23 at a displacement and thus with a pressure p>p1 in the high-pressure chamber. F2 is the load required to pull the rod to its extreme displacement position X2. At this position the pressure will be p2 in the high-pressure chamber.

Figure 10:
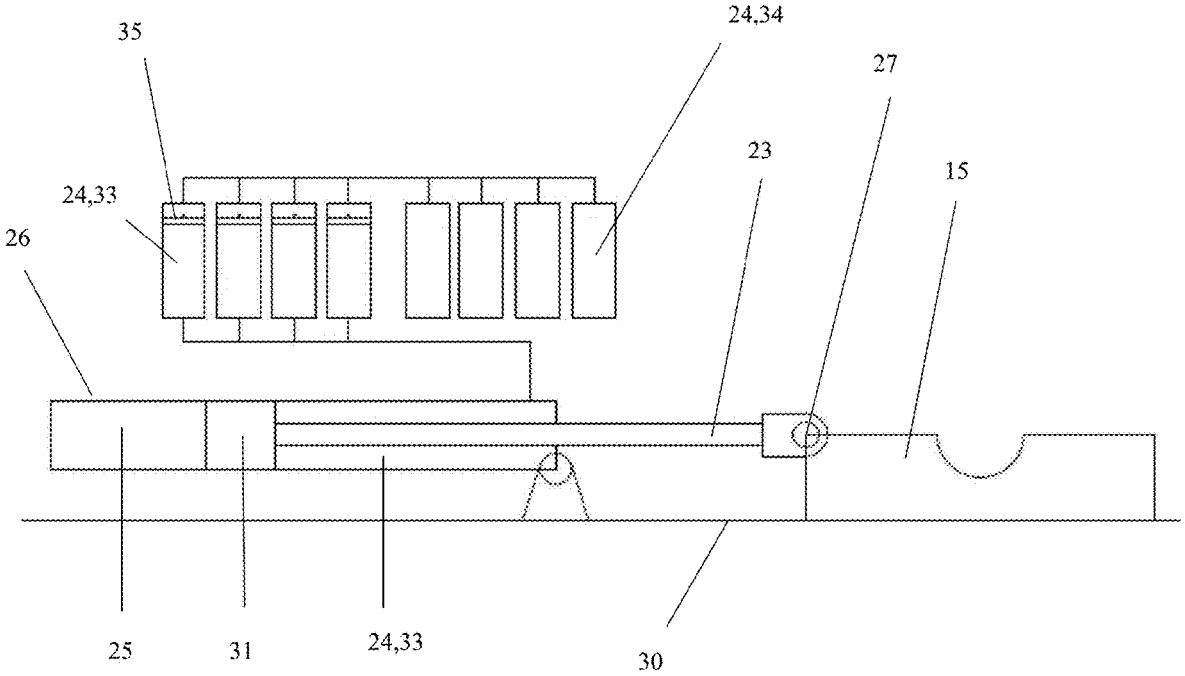
FIG. 10 shows a principal arrangement of the energy absorber based on a combination of incompressible and compressible fluid.

FIG. 10 shows another possible arrangement of the energy absorption device 22. In this arrangement a combination of compressible and incompressible fluid is utilized as an absorption medium, where the compressible fluid typically will be nitrogen gas and the incompressible fluid will typically be oil. The compressible fluid 34 and the incompressible fluid 33 is then separated by a membrane or another type of seal arrangement 35 in external tanks. The pressure on each side of the separation device 35 will be the same.

In addition to the spring effect (force dependent on displacement) the piping arrangement between the main body 26 and the external pressure chambers can be designed such that the compressible fluid also provides a flow velocity dependent force.

Figure 11:
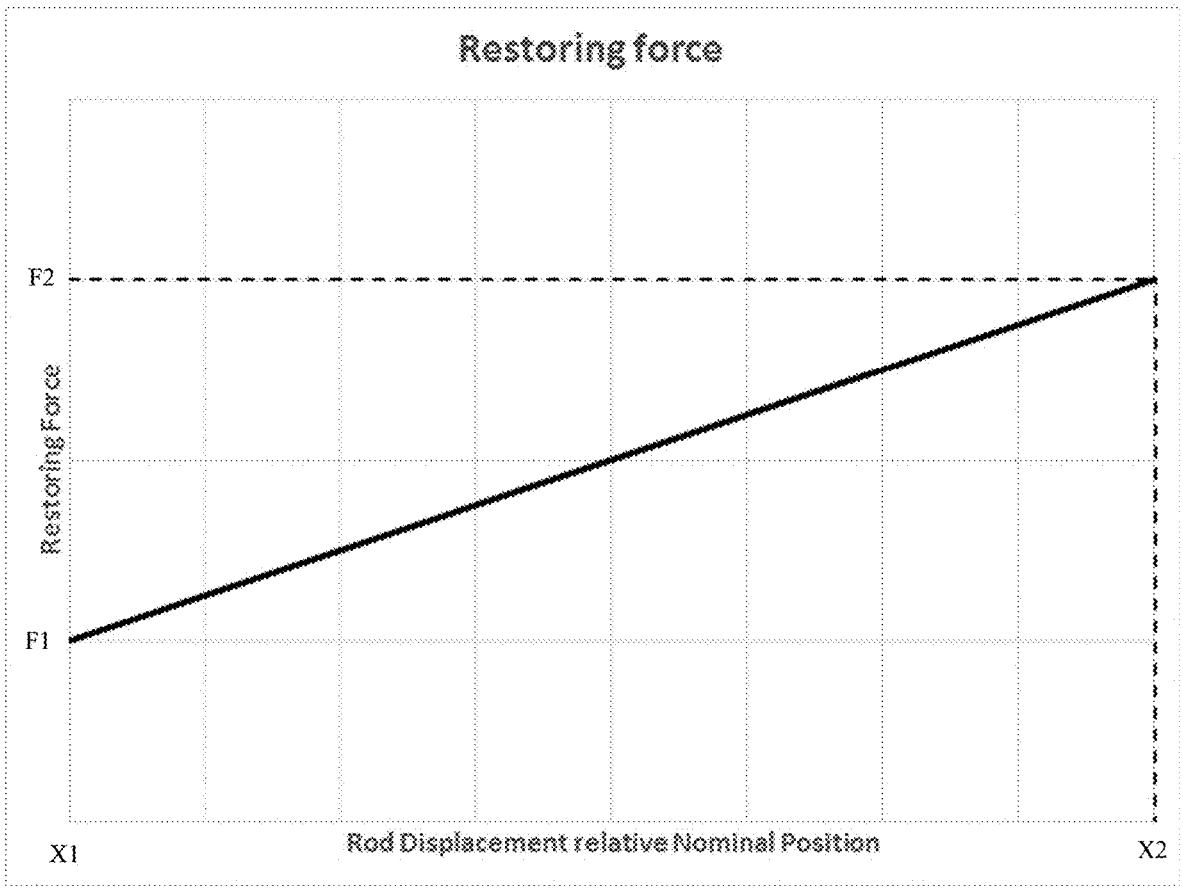
FIG. 11 shows a typical restoring force as function of rod displacement for the energy absorber.

FIG. 11 shows a typical restoring force of the energy absorbing device 22, where the working range is between position X1 and X2, where X1 refers to a load F1 in the rod 23 and X2 refers to a load F2>F1 in the rod, and respectively to a pressure p1 and p2 in the high-pressure chamber 24. In between the extremities defined by the points (X1, F1) and (X2, F2) the restoring force versus displacement will depend on the characteristics of the damping system, which may be linear or non-linear.

In another embodiment the restoring characteristic of the energy absorbing device 22 can be obtained by using a mechanical spring or a combination of spring and fluids as an absorption medium.

It may be beneficial with an inclined sliding path 30 to compensate for vessel trim and pitch motion and tether load direction, and thus obtain a sliding direction closer to the mooring tether direction. The principals of such an arrangement is shown in FIG. 12.

Figure 13:
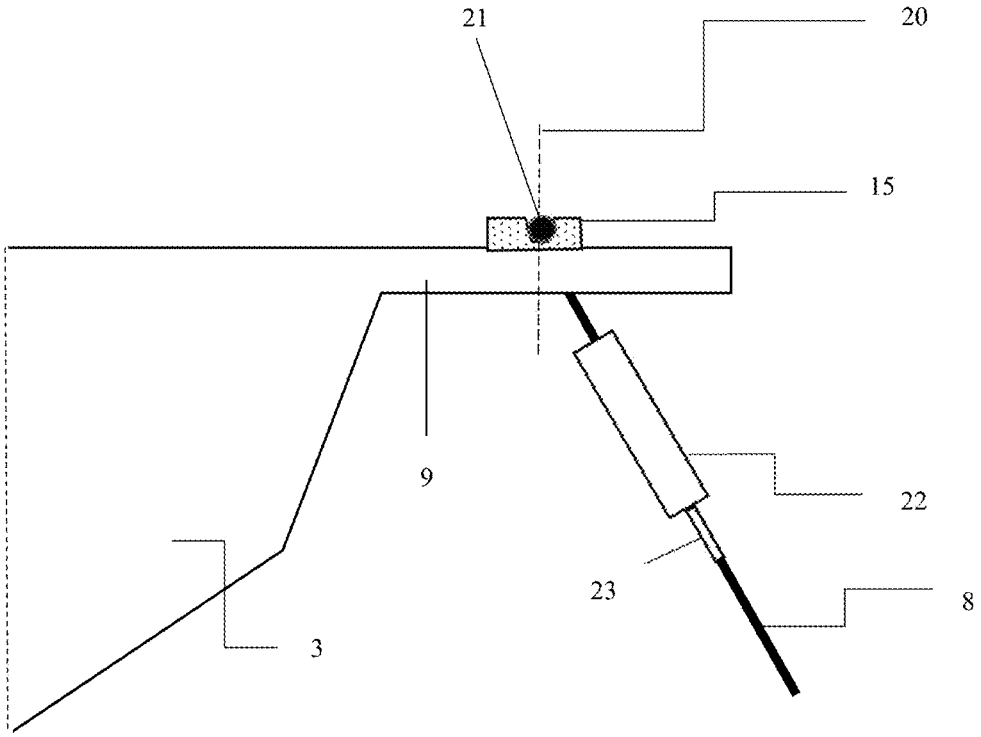
FIG. 13 shows an arrangement with fixed cradle position and energy absorber device as part of mooring tether.

In another embodiment the peak energy absorber can be located elsewhere in the yoke system. FIG. 13 shows the peak energy absorber 22 as part of the mooring tether 8. Another alternative is to integrate the peak energy absorber in the node 17 of the yoke 6.

Although specific embodiments of the invention have been described and illustrated herein, it is recognized that modifications and variations may readily occur to those skilled in the art, and consequently, it is intended that the claims be interpreted to cover such modifications and equivalents.

REFERENCE NUMERALS

1 Sea floor
2 Sea surface
3 Floating structure, vessel or ship
4 Structure attached to sea floor
5 Foundation means for attaching structure on sea floor to sea floor, such as pile
6 Mooring yoke
7 Weighted pendulum member of mooring yoke
8 Mooring tether
9 Mooring hang-off arm on vessel
10 Flexible fluid line
11 Tower structure
12 Topside including fluid swivel
13 Access bridge
13*a* Access bridge when connected to topside
13*b* Access bridge when parked on vessel
14 Mooring turret for rotation about z-axis
15 Mooring cradle on vessel
16 Attachment means between tethers and mooring yoke
17 Rotational means for rotation about x-axis
18 Rotational means for rotation about y-axis
19 Groove in mooring cradle for main connecting pin of mooring tether.
20 Neutral position for mooring cradle

21 Main connecting pin of mooring tether
21 Energy absorbing device/energy absorber
22 Rod in energy absorbing device
23*a* Rod in energy absorbing device at nominal displacement
23*b* Rod in energy absorbing device at maximum displacement
24 High-pressure chamber
25 Low-pressure chamber
26 Main body of energy absorbing device
27 Connection point between rod and mooring cradle
28 Inner stopper device for mooring cradle
29 Outer stopper device for mooring cradle
30 Sliding path for mooring cradle
31 End plate of rod
32 Pressure seal
33 Incompressible fluid, such as oil
34 Compressible fluid, such as gas
35 Barrier between incompressible fluid and compressible fluid

The invention claimed is:

1. An energy absorption arrangement for reducing peak mooring loads between a mooring structure with a turret rotatable around a vertical axis (Z), and a floating structure, wherein the energy absorption arrangement; comprises:

a rigid yoke horizontally rotatable in two axes (X, Y) and connected to the turret a weighted pendulum member arranged on an end of the rigid yoke and at least one mooring tether connected to the weighted pendulum member, and at least one energy absorption device for reducing peak mooring loads, comprising a fixed part connected to the floating structure, a movable rod having an outer end, and an absorption medium, wherein a mooring loads up to a first predetermined load (F1) absorbed by the weighted pendulum, and mooring loads higher than the first predetermined load (F1) are absorbed by the at least one energy absorption device, wherein the outer end of the movable rod is connected to the at least one mooring tether, and the movable rod has an initial first length (X1) when exposed to a mooring load up to the first load (F1), and is extended a second length (X2) when exposed to a second load (F2) greater than the first load (F1) and the second length (X2) is longer than the first length (X1), and the at least one energy absorption device exerts a restoring force opposite of the first load (F1) and second load (F2), causing the movable rod to retract from its second length (X2) to its first length (X1) when the mooring loads decrease from the second load (F2) to the first load (F1).

2. The energy absorption arrangement according to claim 1, wherein the outer end of the movable rod is fastened to a cradle and wherein the cradle is movable along a sliding path when the at least one energy absorption device extends or retracts.

3. The energy absorption arrangement according to claim 2, wherein the sliding path has a horizontal inclination angle.

4. The energy absorption arrangement according to claim 3, wherein the at least one energy absorption device and the cradle are situated on a mooring arm protruding from a bow or a stern of the floating structure.

5. The energy absorption arrangement according to claim 3, wherein the at least one energy absorption device comprises a high-pressure chamber and a low-pressure chamber.

6. The energy absorption arrangement according to claim 3, wherein the absorption medium is either a compressible fluid, an incompressible fluid, a mechanical spring or a combination of the compressible fluid, the incompressible fluid, and the mechanical spring.

7. The energy absorption arrangement according to claim 2, wherein the sliding path has an inclination angle different from horizontal.

8. The energy absorption arrangement according to claim 7, wherein the at least one energy absorption device and the cradle are situated on a mooring arm protruding from a bow or a stern of the floating structure.

9. The energy absorption arrangement according to claim 7, wherein the at least one energy absorption device comprises a high-pressure chamber and a low-pressure chamber.

10. The energy absorption arrangement according to claim 7, wherein the absorption medium is either a compressible fluid, an incompressible fluid, a mechanical spring or a combination of the compressible fluid, the incompressible fluid, and the mechanical spring.

11. The energy absorption arrangement according to claim 2, wherein the sliding path comprising an inner stopper and an outer stopper, wherein a distance between the inner stopper and the outer stopper defines a sliding range of the mooring cradle.

12. The energy absorption arrangement according to claim 11, wherein the at least one energy absorption device and the cradle are situated on a mooring arm protruding from a bow or a stern of the floating structure.

13. The energy absorption arrangement according to claim 2, wherein the at least one energy absorption device and the cradle are situated on a mooring arm protruding from a bow or a stern of the floating structure.

14. The energy absorption arrangement according to claim 2, wherein the at least one energy absorption device comprises a high-pressure chamber and a low-pressure chamber.

15. The energy absorption arrangement according to claim 2, wherein the absorption medium is either a compressible fluid, an incompressible fluid, a mechanical spring or a combination of the compressible fluid, the incompressible fluid, and the mechanical spring.

16. The energy absorption arrangement according to claim 2, wherein the at least one energy absorption device comprises a pump arrangement for control of the predetermined first load (F1) and the second load (F2).

17. The energy absorption arrangement according to claim 1, wherein the at least one energy absorption device comprises an inner stopper and an outer stopper, wherein a distance between the inner stopper and the outer stopper defines a distance between the first length (X1) and the second length (X2) of the movable rod.

18. The energy absorption arrangement according to claim 1, wherein the at least one energy absorption device comprises a high-pressure chamber and a low-pressure chamber.

19. The energy absorption arrangement according to claim 1, wherein the absorption medium is either a compressible fluid, an incompressible fluid, a mechanical spring or a combination of the compressible fluid, the incompressible fluid, and the mechanical spring.

20. The energy absorption arrangement according to claim 1, wherein the at least one energy absorption device comprises a pump arrangement for control of the predetermined first load (F1) and the second load (F2).

* * * * *